US006945807B1

(12) United States Patent
Wu

(10) Patent No.: US 6,945,807 B1
(45) Date of Patent: Sep. 20, 2005

(54) CABLE END CONNECTOR HAVING INTEGRAL LATCH MEANS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/988,674

(22) Filed: Nov. 15, 2004

(51) Int. Cl.[7] ..... H01R 13/627
(52) U.S. Cl. ..... 439/354; 439/357
(58) Field of Search ..... 439/344, 352, 439/354, 358, 357

(56) References Cited

U.S. PATENT DOCUMENTS 4,986,766 A * 1/1991 Leonard et al. ..... 439/352
6,364,685 B1 * 4/2002 Manning ..... 439/357
6,383,011 B2 * 5/2002 Chen ..... 439/358
6,431,887 B1 8/2002 Yeomans et al.
6,585,537 B1 * 7/2003 Lee ..... 439/358

* cited by examiner

*Primary Examiner*—Tho D. Ta
(74) *Attorney, Agent, or Firm*—Wei Te Chung

(57) ABSTRACT

A cable end connector (100) includes a housing (1) having a latch means (2) integrally from a top surface thereof. The latch means includes a base (20) extending from the top surface, a deflectable latching arm (22) extending from the base in spaced relationship to the top surface, a pair of hooks (24) extending from the latching arm, a pushing portion (26) on generally the same side of the latch means as the hooks and at a location along the latch means remote from the base, and a pair of arciform side ribs (28) extending unitarily from the housing along a direction offset from a vertical direction and unitarily connected to the latch means remote from the base for preventing overdeflection of the latch means away from the top surface.

12 Claims, 7 Drawing Sheets

CABLE END CONNECTOR HAVING INTEGRAL LATCH MEANS

BACKGROUND OF THE INVENTION

1. Field of the Invention

The present invention generally relates to a cable end connector, and more particularly to a Serial Advanced Technology Attachment (Serial ATA) cable end connector with an improved integral latch means.

2. Description of Related Art

There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations. For providing a reliable mechanical connection and electrical connection therebetween, mated Serial ATA connectors usually include latch means for securely but releasably retaining a pair of electrical connector housings in a mated condition.

U.S. Pat. No. 6,431,887 B1 discloses an electrical plug having a latch assembly. With reference to FIGS. 1 and 5 of the patent, the latch assembly 18 includes a T-shaped principle section 132, integrally formed with side flanges 134, a front plate 136 and a leading section 138. The front plate 136 includes a locking member 139 extending upward. The locking member 139 latchably engages a hole defined in a top of a receptacle when the plug is inserted into the receptacle. The side flanges includes holes 140 that are snapped over knobs formed in the plug and the leading section 138 includes a hole 144 that receives a knob projecting from a front face of the plug to secure the latch assembly 18 onto the plug.

However, since the locking assembly is a single and separated element, it is no doubt that this structural design will complicate the manufacturing and assembling processes of the whole plug. Unitarily molded electrical connector housings are generally considered in that they can yield certain manufacturing efficiencies, and simplify the installation and use of the connector. Thus, it is desirable to unitarily mold an entire electrical connector housing including the latch means thereof.

Hence, it is desired to provide an electrical connector having an improved integral latch means to avoid the foregoing drawbacks.

SUMMARY OF THE INVENTION

An object of the present invention is to provide a cable end connector having an improved integral latch means which has a larger displacement.

In order to achieve the object set forth, a cable end connector in accordance with the present invention comprises a dielectric housing having a resilient deflectable latch means integrally from a top surface thereof, a plurality of contact units each having a fork-shaped configuration, a spacer attached to a rear portion of the housing, a plurality of wires electrically connected to corresponding tail portions of the contact units, and a cover over-molded with a rear end of the housing and front ends of the contact units. The housing defines a recessed portion in the top surface thereof. The latch means includes a base extending from the top surface, a deflectable latching arm extending from the base in spaced relationship to the recessed portion, a pair of hooks extending from the latching arm, a pushing portion on generally the same side of the latch means as the hooks and at a location along the latch means remote from the base, and a pair of arciform side ribs extending unitarily from the housing along a direction offset from a vertical direction and unitarily connected to the latch means remote from the base for preventing overdeflection of the latch means away from the recessed portion.

Other objects, advantages and novel features of the invention will become more apparent from the following detailed description when taken in conjunction with the accompanying drawings.

DETAILED DESCRIPTION OF THE INVENTION

Figure 1:
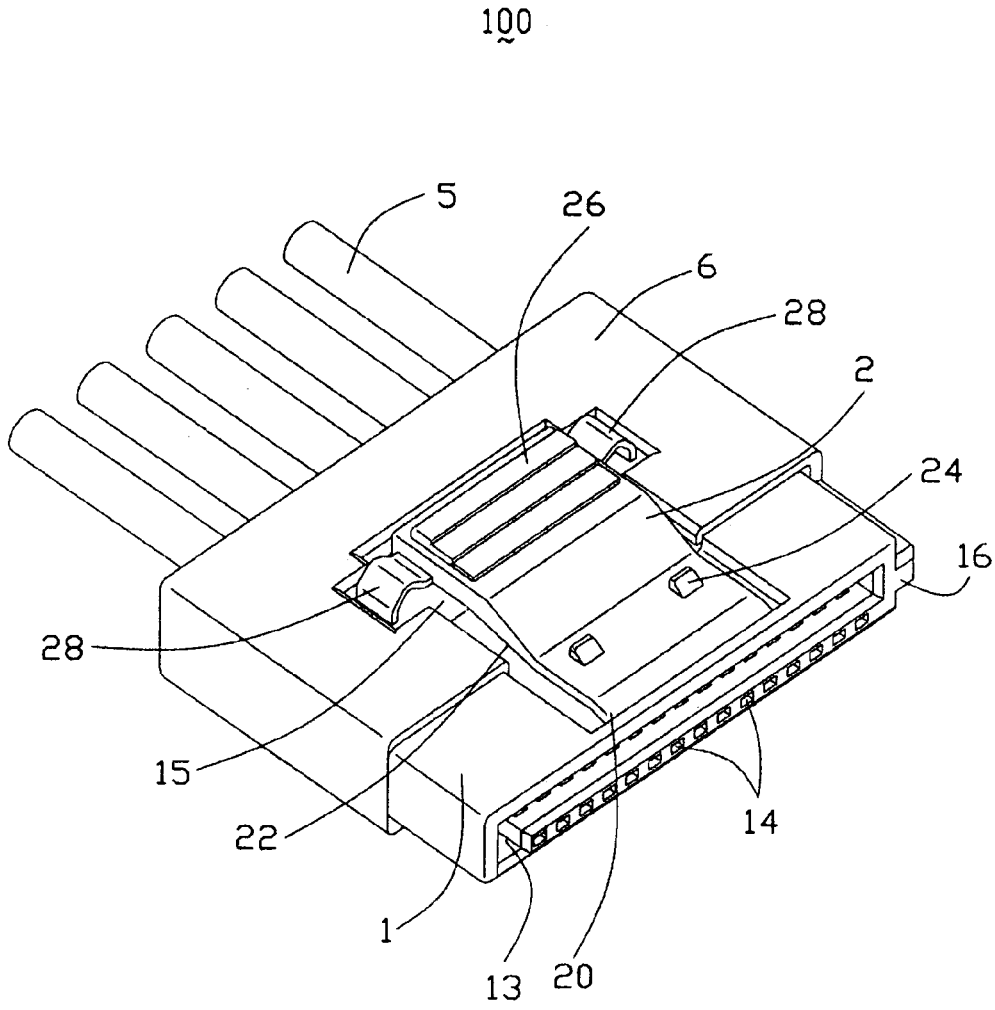
FIG. 1 is an assembled, perspective view of a cable end connector in accordance with the present invention.
Figure 2:
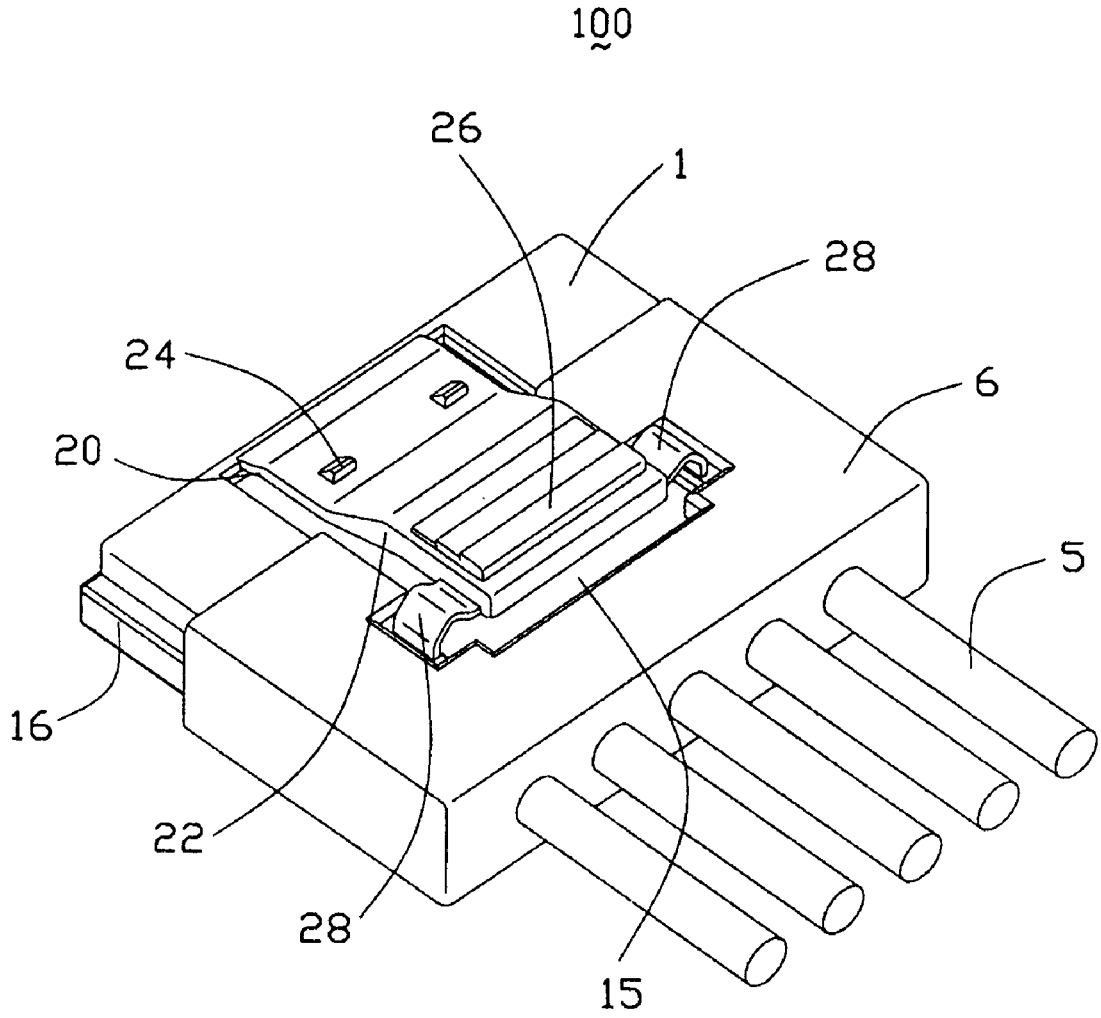
FIG. 2 is a view similar to FIG. 1, but taken from a rear aspect.

Reference will now be made in detail to the preferred embodiment of the present invention.

Referring to FIGS. 1–4, a cable end connector 100 in accordance with the present invention comprises a unitarily molded dielectric housing 1 with an integral latch means 2 for latching with a complementary electrical connector (not shown), a plurality of contact units 3, a spacer 4, a plurality of wires 5, and a cover 6. In the preferred embodiment of the present invention, the cable end connector 100 is in the form of a Serial ATA cable end connector.

Figure 3:
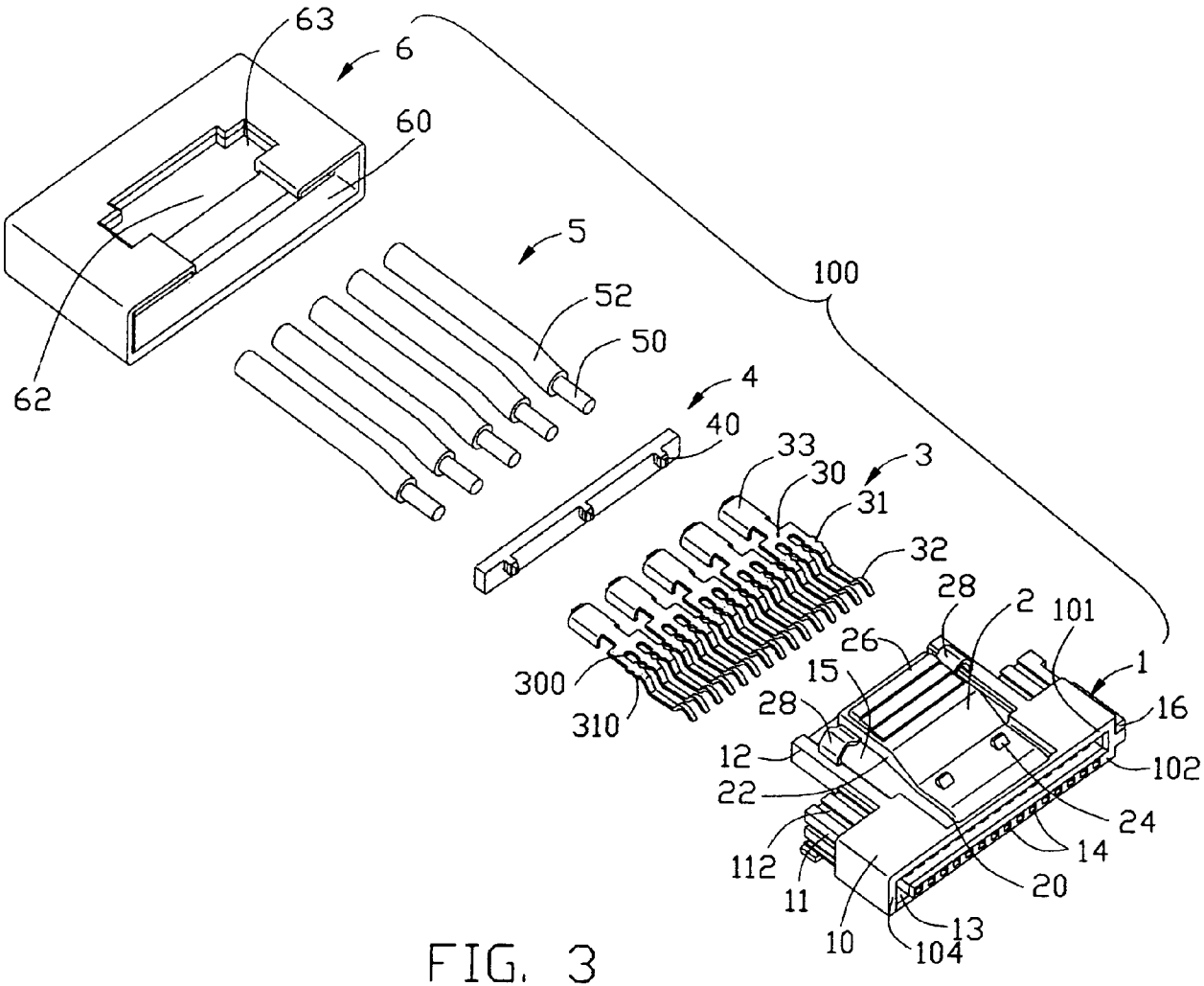
FIG. 3 is an exploded, perspective view of FIG. 1.
Figure 4:
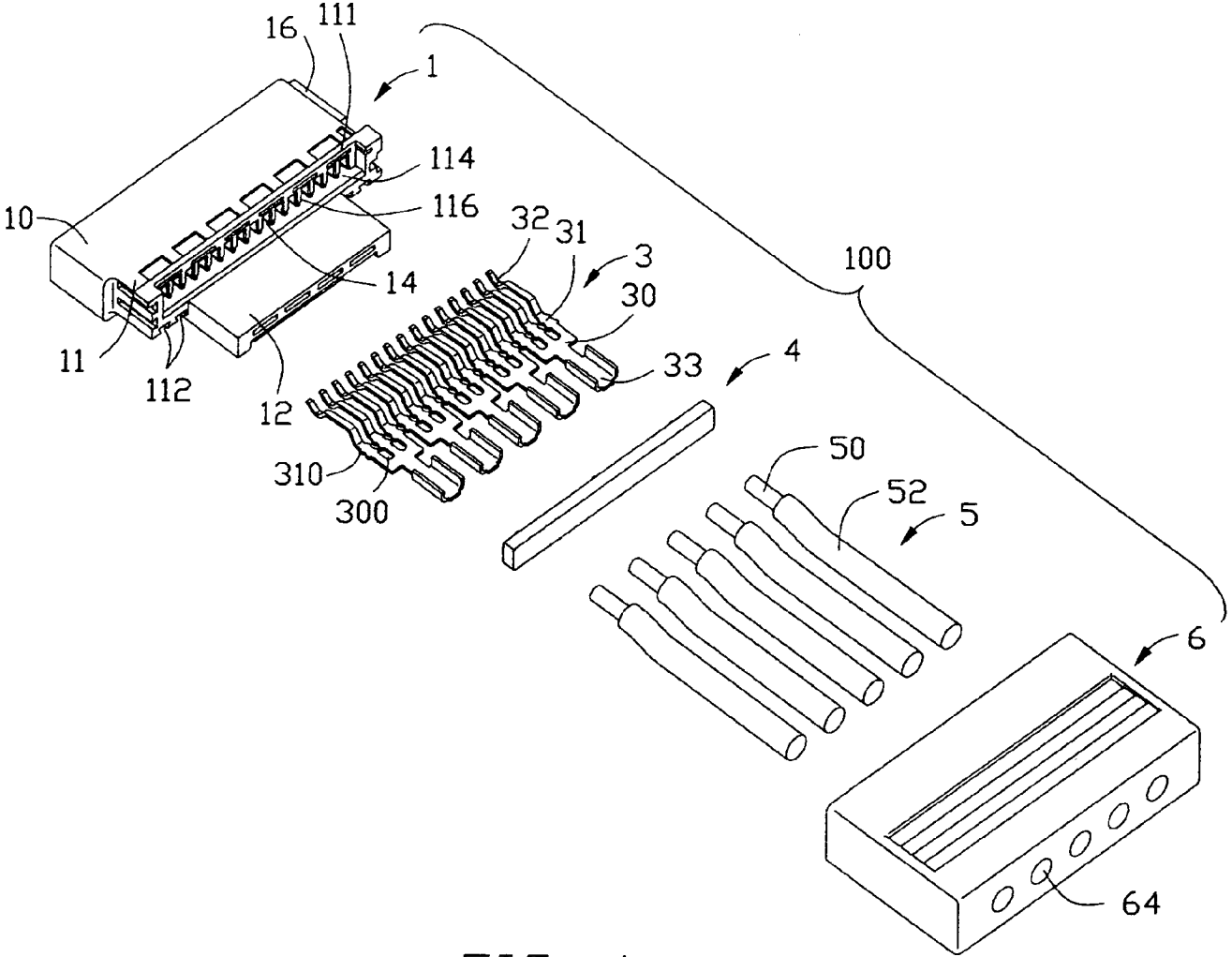
FIG. 4 is a view similar to FIG. 3, but taken from rear and bottom aspects.
Figure 5:
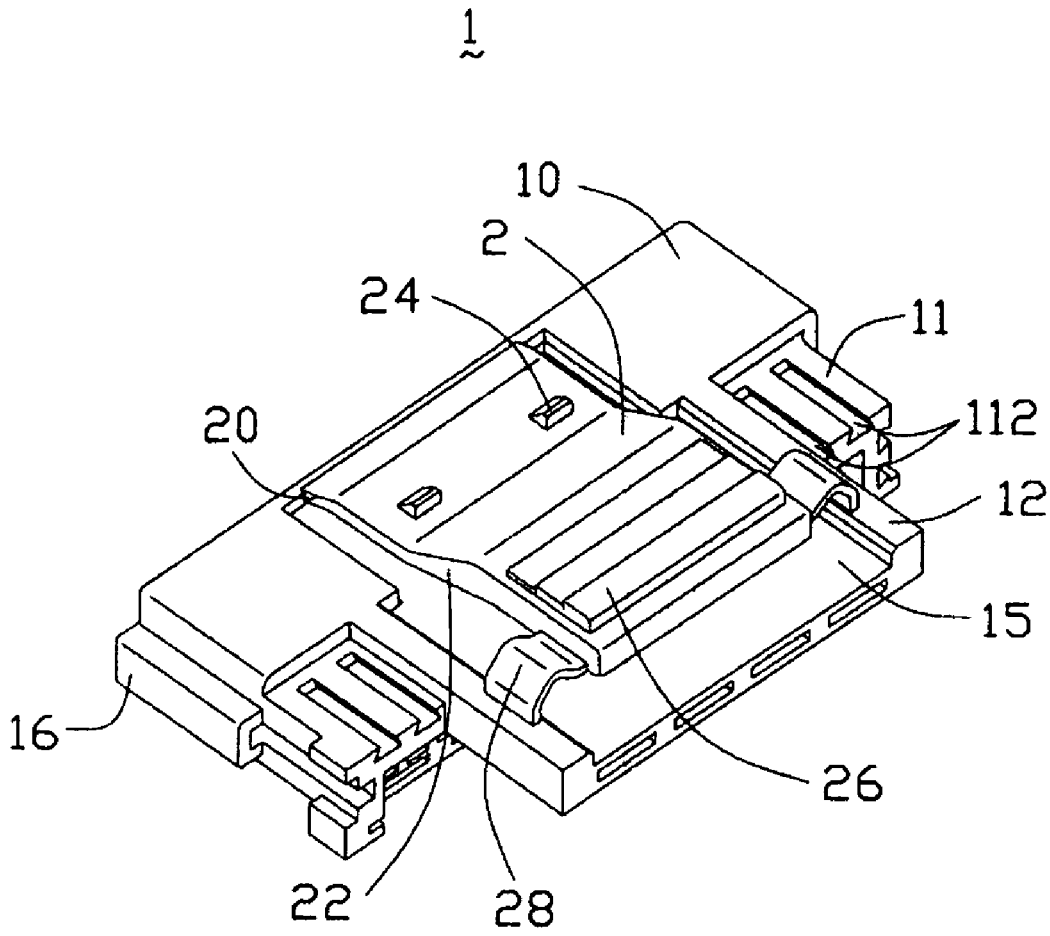
FIG. 5 is a perspective view of a dielectric housing of FIG. 3 from a rear aspect.

With reference to FIGS. 3–4 in conjunction with FIG. 5, the dielectric housing 1 comprises a mating section 10, a connecting section 11 extending rearwardly from the mating section 10, and an extending section 12 protruding rearwardly from a middle portion of the connecting section 11 along a top surface of the connecting section 11. The mating section 10 includes an upper wall 101, a lower wall 102 opposite to the upper wall 101, and a pair of sidewalls 104 connecting the upper and lower walls 101, 102. The upper wall 101, the lower wall 102, and the sidewalls 104 together define an L-shaped receiving space 13. The lower wall 102 defines a plurality of passageways 14 extending through the connecting section 11 and communicating with the receiving space 13. A recessed portion 15 is formed in top surfaces of the mating section 10, the connecting section 11 and the extending section 12. A guiding projection 16 protrudes sidewardly from a side surface of one sidewall 104 for mating with the complementary connector. The connecting section 11 provides a protruding rib 111 in a longitudinal edge of a bottom wall thereof and defines a plurality of grooves 112 in a circumference thereof for facilitating to engage with the cover 6. A receiving cutout 114 is defined in a rear end of the connecting section 11 of the housing 1 and communicates with the passageways 14 for receiving the spacer 4 therein. The connecting section 11 has a plurality of dividing blocks 116 each formed between adjacent two passageways 14.

The latch means 2 is disposed in the recessed portion 15 and comprises a base 20 which extends unitarily from the dielectric housing 1. A step-shaped deflectable latching arm 22 extends from the base 20 in spaced relationship to the recessed portion 15 of the dielectric housing 1 and generally away from a mating end of the housing 1. A pair of chamfered hooks 24 extend from the latching arm 22 of the latch means 2. The latch means 2 further comprises a pushing portion 26 on generally the same side of the latch means as the hooks 24 and at a location along the latch means 2 remote from the base 20. The latch means 2 is provided with a pair of arciform side ribs 28 which extend unitarily from opposite sides of the extending section 12, and which are unitarily connected to the end of the latch means 2 remote from the base 20. The side ribs 28 can prevent overdeflection of the latch means 2 away from the recessed portion 15 of the housing 1. Furthermore, for enhancing elastic deformation of the side ribs 28, the side ribs 28 in accordance with the present invention first extend upwardly from the housing 1 along a direction offset from a vertical direction to a peak, then extend downwardly from the peak and are last connected to opposite sides of the latch means along a horizontal direction. By virtue of this construction, an external force exerted on the depressible actuator 26 will easily deform the arciform side ribs 28 resiliently so as to deflect the latch means 2 toward the recessed portion 15 of the housing 1 and urge the hooks 24 to disengage from corresponding locking structures on the complementary electrical connector with which the housing 1 is mateable. When the external force is released, the side ribs 28 are thereafter restored to its initial position because of its own elasticity and the latching arm 22 is in a undeflectable position.

In this embodiment of the present invention, the recessed portion 15 is defined in a top surface of the dielectric housing 1 and the latch means 2 has a step-shaped configuration for increasing a displacement of the latch means 2 relative to the top surface of the housing 1. It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

Each contact unit 3 has a fork-shaped configuration and comprises a base portion 30, three retention portions 31 extending forwardly from a middle and a pair of sides of the base portion 30 respectively, three mating portions 32 extending forwardly from corresponding retention portions 31, and a U-shaped tail portion 33 extending rearwardly from a rear edge of the base portion 30. Each retention portion 31 forms a plurality of barbs 310 on a pair of sides thereof. A front edge 300 of the base portion 30 is formed between each two retention portions 31.

The spacer 4 is a rectangular bar and has a plurality of retention protrusions 40 projecting from a front surface thereof.

Each wire 5 comprises a conductive core 50 surrounded by an outer insulating jacket 52.

The cover 6 is preferably comprised of molded plastic or polymer material and over-molded with the connecting section 11 and the extending section 12 of the housing 1 and front ends of the wires 5. A receiving cavity 60 is defined in a front portion of the cover 6 for receiving the connecting section 11 and the extending section 12 of the housing 1. The cover 6 defines an aperture 62 in a top wall thereof corresponding to the latch means 2 and communicating with the receiving cavity 60 for allowing the latch means 2 to expose outwardly therefrom, and further defines a pair of gaps 63 in opposite sides of the aperture 62 for avoiding an interference with the arciform side ribs 28 of the latch means 2. A plurality of receiving holes 64 is defined in a rear portion of the cover 6 corresponding to the wires 5.

Figure 6:
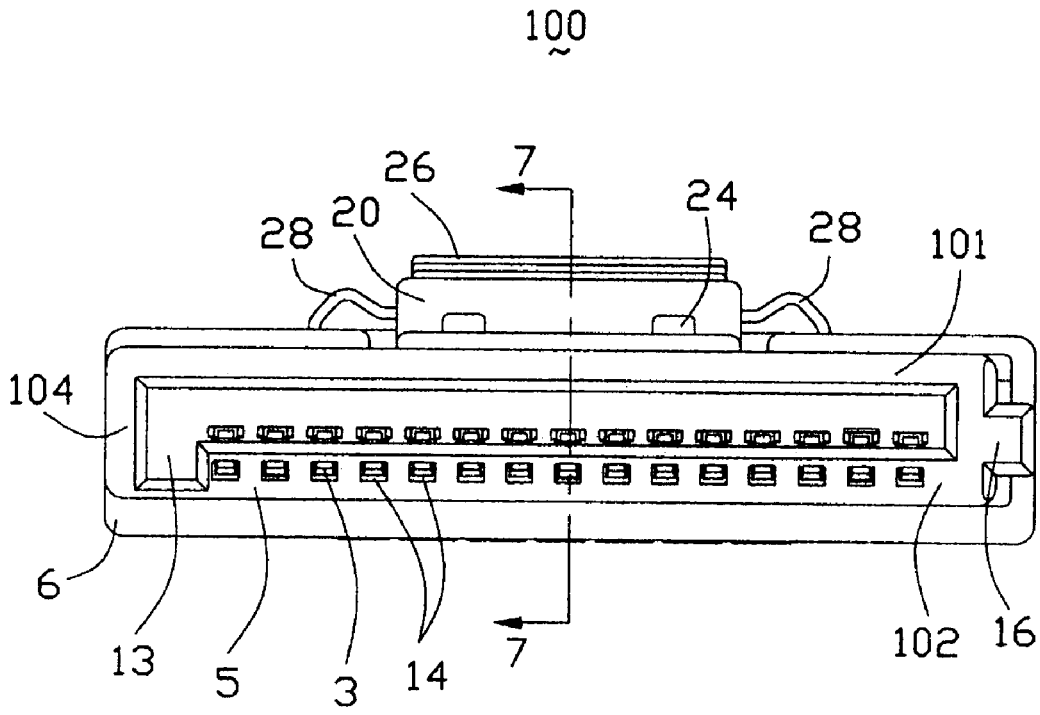
FIG. 6 is a front plane view of the cable end connector of FIG. 1.
Figure 7:
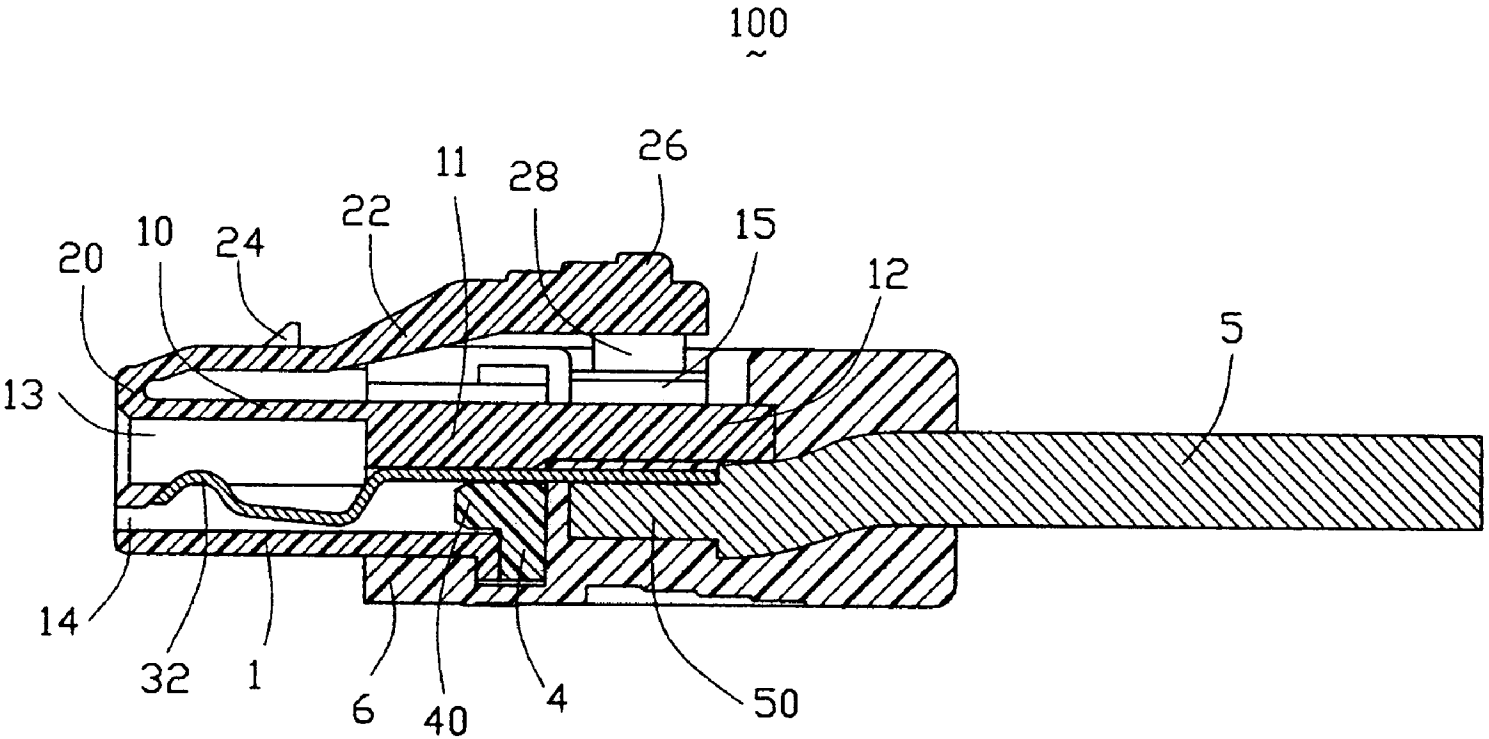
FIG. 7 is a cross-sectional view of the cable end connector taken along line 7—7 of FIG. 1.

In assembly, referring to FIGS. 1–4 in conjunction with FIGS. 6–7, the contact units 3 are first inserted into the dielectric housing 1 in a rear-to-front direction until the front edge 300 of each base portion 30 abuts against a rear surface of a corresponding dividing block 116. Each mating portion 32 of the contact unit 3 protrudes through and is received in a corresponding passageway 14 and is partly exposed in the receiving space 13 for electrically connecting the complementary electrical connector. Each retention portion 31 of the contact unit 3 is received in a corresponding passageway 14 with the barbs 310 engaging with opposite side surfaces of the passageway 14. The U-shaped tail portion 33 of each contact unit 3 is exposed beyond a rear surface of the housing 2 for being soldered with a corresponding front end of the wire 6.

The spacer 4 is pushed and received into the receiving cutout 114 defined in the rear end of the housing 1. The retention protrusions 40 engage with opposite inner surfaces of the passageways 14 so as for securing the spacer 4 to the housing 2 firmly (referring to FIG. 7). The spacer 4 seals the rear end of the housing 1 and efficiently prevents melted plastic material of the cover 6 from entering into the housing 1 and influencing the electrical connection between the cable end connector 100 and the complementary connector.

The conductive cores 50 of the wires 5 are received and soldered onto the tail portions 33 of the contact units 3 respectively. The U-shaped tail potion 33 increases the contact area between the tail portion 33 and the conductive core 50, thus assures reliable connection therebetween.

The cover 6 is at last over-molded with the rear end of the housing 1 and the front ends of the wires 5 with the latch means 2 protruding upwardly from the aperture 62 of the cover 6. The connecting portion 11 and the extending portion 12 of the housing 1 are received in the receiving cavity 60. Each wire 6 is received in a corresponding receiving hole 64. The cover 5 forms a strain relief between the housing 2 and the wires 5, and also protects the electrical connections between the U-shaped tail portions 33 and the conductive cores 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a surface; and a latch means having a base extending unitarily from said surface, a deflectable latching arm extending from the base in spaced relationship to said surface, at least one hook extending from the latching arm, at least one side rib extending unitarily from the housing along a direction offset from a vertical direction and unitarily connected to the latch means remote from the base for preventing over-deflection of the latch means away from said surface;

wherein the latch means includes a pushing portion on generally the same side of the latch means as the at least one hook and at a location along the latch means remote from the base;

wherein the at least one side rib is a pair of side ribs which first extend upwardly from the housing along said direction to a peak, then extend downwardly from the peak and are last unitarily connected to opposite sides of the latch means along a horizontal direction.

2. The electrical connector as claimed in claim 1, wherein the housing defines a recessed portion in a top surface thereof, and the latch means is disposed in the recessed portion and is in spaced relationship to the recessed portion.

3. The electrical connector as claimed in claim 2, wherein the housing includes a mating section, a connecting section extending rearwardly from the mating section, and an extending section protruding rearwardly from a middle portion of the connecting section along a top surface of the connecting section, and said recessed portion is disposed in top surfaces of the mating section, a connecting section and the extending section.

4. The electrical connector as claimed in claim 3, wherein the mating section defines an L-shaped receiving space and a plurality of passageways in a lower wall thereof extending through the connecting section and communicating with the receiving space, and has a guiding projection in one side wall thereof.

5. The electrical connector as claimed in claim 4, wherein the connecting section of the housing defines a receiving cutout in a rear end thereof and a plurality of grooves in a circumference thereof.

6. The electrical connector as claimed in claim 5, further comprising a plurality of contact units received in the housing and a plurality of wires each having a conductive core surrounded by an outer insulating jacket and electrically connected to a corresponding contact unit.

7. The electrical connector as claimed in claim 6, wherein each contact unit has a fork-shaped configuration and comprises a base portion, three retention portions extending forwardly from a middle and a pair of sides of the base portion respectively, three mating portions extending forwardly from corresponding retention portions, and a U-shaped tail portion extending rearwardly from a rear edge of the base portion.

8. The electrical connector as claimed in claim 6, further comprising a spacer received in said receiving cutout and having a plurality of retention protrusions projecting from a front surface thereof.

9. The electrical connector as claimed in claim 8, further comprising a cover over-molded with the connecting section and the extending section of the housing and front ends of the wires.

10. The electrical connector as claimed in claim 9, wherein the cover defines an aperture in a top wall thereof for allowing the latch means to protrude therefrom and a pair of gaps in opposite sides of the aperture for avoiding an interference with the pair of side ribs.

11. An electrical connector comprising:

a dielectric housing comprising a surface; and a latch means having at a front end thereof a base extending from said surface, a deflectable latching arm extending from the base in spaced relationship to said surface, at least one hook extending from the latching arm around said front end, at least one curved flexible rib extending unitarily from the housing and unitarily connected to the latch means at a rear end of the latch means for preventing over-deflection of the latch means away from said surface;

wherein the rear end of the latch means is farthest from the surface farther than any other portions of the latch means;

wherein there are two curved flexible ribs located on two opposite lateral side of the latch means around said rear end;

wherein a bottom end of said curved flexible rib is located spaced, with a distance, from said lateral side of the latch means laterally.

12. The connector as claimed in claim 11, wherein a cover is molded over the housing, surrounding the latch means to hide said bottom end for protection.

* * * * *